US006655390B2

(12) United States Patent
Gueret

(10) Patent No.: US 6,655,390 B2
(45) Date of Patent: Dec. 2, 2003

(54) DEVICE FOR APPLYING A SUBSTANCE TO THE EYELASHES OR THE EYEBROWS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 179 days.

(21) Appl. No.: 09/884,213

(22) Filed: Jun. 18, 2001

(65) Prior Publication Data

US 2002/0005209 A1 Jan. 17, 2002

(30) Foreign Application Priority Data

Jun. 28, 2000 (FR) ..... 00 08312

(51) Int. Cl.[7] ..... A45D 40/26; A46B 9/02

(52) U.S. Cl. ..... 132/218; 132/138; 132/139; 132/317; 132/320; 401/126; 15/207.2

(58) Field of Search ..... 132/218, 216, 132/104, 120, 138, 137, 139, 159, 160, 162, 308, 313, 317, 320, 901; 401/126, 127, 129, 130, 122; 15/207.2, 160, 187, 206; D28/29; D4/106, 136, 131

(56) References Cited

U.S. PATENT DOCUMENTS 606,184 A * 6/1898 Burnip ..... 15/160
1,939,996 A * 12/1933 Lockwood ..... 15/167.1
3,763,870 A * 10/1973 Montgomery et al. ..... 132/218
3,896,823 A * 7/1975 Spatz ..... 132/218
4,056,863 A * 11/1977 Gunjian ..... 15/160
D253,321 S * 11/1979 Saute ..... D4/35
D260,949 S * 9/1981 Megna ..... D4/35
D264,275 S * 5/1982 Megna ..... D4/35
4,446,880 A 5/1984 Gueret et al. ..... 132/88.5
4,458,701 A * 7/1984 Holland ..... 132/218
4,565,205 A * 1/1986 Taylor ..... 132/218
D304,466 S * 11/1989 Brown ..... D21/61
5,007,442 A * 4/1991 Hirzel ..... 132/218
5,052,839 A * 10/1991 Pettengill ..... 401/126
5,123,431 A * 6/1992 Wilson ..... 132/320
5,490,529 A * 2/1996 Fitjer ..... 132/218
5,497,526 A * 3/1996 Klinkhammer ..... 15/167.2
5,611,361 A 3/1997 Leone ..... 132/218
5,765,573 A * 6/1998 Gueret ..... 132/218
5,775,343 A * 7/1998 Zarn ..... 132/210
D401,418 S * 11/1998 Vrignaud ..... D4/106
6,029,675 A * 2/2000 Dumler ..... 132/218
6,067,684 A * 5/2000 Kweon ..... 15/167.1
6,220,254 B1 * 4/2001 Gueret ..... 132/313
6,408,857 B1 * 6/2002 Neuner ..... 132/218

OTHER PUBLICATIONS

French Search Report dated Apr. 6, 2001.

* cited by examiner

*Primary Examiner*—Eduardo C. Robert
*Assistant Examiner*—David C Comstock
(74) *Attorney, Agent, or Firm*—Finnegan, Henderson, Farabow, Garrett & Dunner, LLP

(57) ABSTRACT

An applicator capable of applying a substance, in particular a cosmetic or care product, on the eyelashes or eyebrows, the applicator comprising an open support defining at least one opening situated between two opposite regions of the support, with protruding elements connected to at least one of said regions and extending towards the other region.

92 Claims, 5 Drawing Sheets

DEVICE FOR APPLYING A SUBSTANCE TO THE EYELASHES OR THE EYEBROWS

The present invention relates to the field of making up and/or treating keratinaceous fibers or "hairs", in particular the eyelashes or the eyebrows.

BACKGROUND OF THE INVENTION

In general terms, there exists a need to have an applicator capable of picking up a relatively large quantity of substance so that the user does not need to refill the applicator too often while making up.

In known applicators comprising a row of teeth, the quantity of substance retained between the teeth depends on their spacing, and it is limited by the fact that the teeth must remain relatively close together in order to grip the eyelashes.

OBJECTS AND SUMMARY OF THE INVENTION

The present invention seeks to propose a novel applicator capable in particular of making up the eyelashes or the eyebrows in satisfactory manner, while offering the possibility of being used for a sufficient length of time and also being comfortable to use.

The invention achieves this by the applicator including a support defining at least one opening situated between two opposite regions of the support, and protruding elements connected to at least one of said regions and directed towards the other region.

By means of the invention, it is possible to make an applicator having protruding elements arranged in such a manner as to take hold of the eyelashes while nevertheless having a supply of substance available that enables the applicator to continue being used for a sufficient length of time between refills and also enabling the eyelashes to be appropriately coated in substance at the time of use.

Furthermore, the applicator of the invention is easy to manufacture, the protruding elements being suitable for being cut out in the support or the opening of the support which is taken advantage of for unmolding the protruding elements.

At least a fraction of the protruding elements can be made on each opposite region of the support by being molded or injected onto the support, or by being cut out and deformed from a sheet of metal.

The invention makes it possible for a single support to carry protruding elements of different kinds and/or configurations, in particular protruding elements of a given type whose orthogonal projection extends at least in part into the opening of the support, and protruding elements of another type, situated at the outer periphery of the support.

In a particular embodiment, the support is closed around the above-mentioned opening.

In a variant, the support can be generally U-shaped, in which case it is not completely closed around the opening.

The support can be plane, or in a variant it can be non-plane.

The support can also present a boat-shaped configuration or it can be bent.

In particular, the support can be generally elongate in shape along a longitudinal axis and it can be bent about said axis and around a transverse axis.

In a particular embodiment, the support is connected at one end to a link member which is connected to a handle member.

By way of example, the link member can be constituted by a stalk.

Under such circumstances, the support advantageously presents a generally tapering shape towards the end remote from the link member, so as to make the support easier to insert through a wiper member.

The support can be generally elongate in shape, having a longitudinal axis that is parallel to or transverse to the axis of the link member.

All or some of the protruding elements present respective free ends situated at a distance from the region of the support opposite the region to which they are connected.

Thus, some of the protruding elements can form bridges of material in two opposite regions of the support, e.g. so as to make the support more rigid.

Such bridges of material can also serve to hold at least one protrusion-forming element, such as a tooth or a point or tip.

In particular, the applicator can have one or more bridges of material extending in the longitudinal direction of the support, or in a variant in its transverse direction.

In a particular embodiment, the applicator of the invention has a succession of curved bridges of material extending to the same side of the opening, or alternately to opposite sides thereof.

When the support is elongate in shape, at least some of the protruding elements can be connected to a region of the support that extends substantially parallel to its longitudinal direction.

The support can be made of an elastomer material.

The support can also be made of a material that is more rigid than the material used for making the applicator elements.

This makes it possible to improve comfort in use because the protruding elements are more flexible than the support.

The support can be composite in structure, e.g. comprising metal reinforcements with a coating of plastics material around the reinforcements.

Under such circumstances, at least some of the protruding elements can be made out of the same material as the material used for making said coating, with other protruding elements optionally being made of the same material as the reinforcement.

This makes it possible to have protruding elements of different hardnesses within the same applicator.

The applicator can also have protruding elements protruding from two opposite regions of the support, the orthogonal projections of said elements onto the opening formed between said regions extending at least part of the way across the opening.

Advantageously, the protruding elements are then interleaved.

This makes it possible for the protruding elements to form forks or V-shaped grooves in which the eyelashes can be engaged.

Such forks or V-shaped grooves serve to smooth the substance onto the surface of the eyelashes, to lengthen them, and to take hold of them in order to curve them.

The applicator can have protruding elements on one side only of the support, or in a variant, on both sides of the support.

In particular, the applicator can have a first group of protruding elements that are interleaved above the support and a second group of protruding elements that are interleaved beneath the support.

The applicator can have protruding elements that extend alternately from opposite sides of the opening.

The protruding elements extending from the same side of the support can have bases that do not touch.

The applicator can have a succession of protruding elements of lengths that vary as a function of their positions on the support.

In particular, the lengths of said protruding elements can increase on going away from one end of the support.

The applicator can have protruding elements whose orthogonal projections lie entirely within the opening.

The applicator can also have protruding elements whose orthogonal projections are situated in part in the opening and in part on the support.

At least a fraction of the protruding elements can be constituted by teeth of generally tapering shape.

For at least a fraction of the protruding elements, the angle formed by said elements with their orthogonal projections can lie strictly between 5° and 90°, and preferably in the range 10° to 50°, and more preferably in the range 15° to 30°.

The angle in question is selected as a function of the desired makeup, and as a function of the shape and the configuration of the protruding elements.

At least a fraction of the protruding elements can be rectilinear in shape, or otherwise, in particular, they can be curved.

At least a fraction of the protruding elements can have surfaces that present flocking, relief that is visible to the naked eye, or a coating for improving the sliding of eyelashes.

The protruding elements can be made of plastics material, preferably integrally with the support.

The plastics material can have a filler constituted by a biocide, a material for improving slip, or magnetic particles.

The length of the protruding elements can, for example, lie in the range 0.5 millimeters (mm) to 10 mm, and preferably lies in the range 2 mm to 6 mm.

The protruding elements preferably co-operate with the support to define an applicator member whose maximum transverse dimension d parallel to the opening is greater than the maximum transverse direction perpendicular to the opening.

The invention also provides a packaging and applicator device fitted with such an applicator and a receptacle for containing a substance to be applied.

BRIEF DESCRIPTION OF THE DRAWINGS

The invention will be better understood on reading the following detailed description of non-limiting embodiments, and on examining the accompanying drawings, in which.

MORE DETAILED DESCRIPTION

Figure 1:
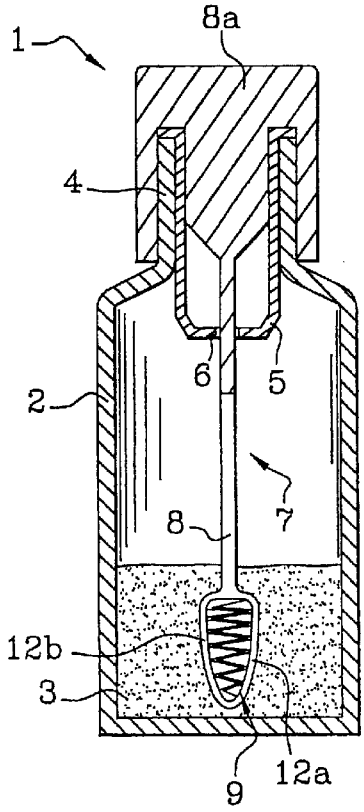
FIG. 1 is a diagrammatic axial section view of a packaging and applicator device including an applicator of the invention.

The packaging and applicator device 1 shown in FIG. 1 comprises a receptacle 2 containing a supply 3 of a cosmetic and/or treatment product for the eyelashes or the eyebrows, e.g. mascara.

The receptacle 2 has a neck.

The inside of the opening of the receptacle 2 has a wiper member 5 constituted in conventional manner by a piece of elastomer inserted in the neck 4, and presenting at the bottom a circular wiper orifice 6.

The device 1 includes an applicator 7 comprising a stalk 8 of axis X, provided at one end with an applicator element 9 and at its other end with a handle element 8*a* that also serves as a cap for closing the receptacle 2 in sealed manner, and arranged to engage on the neck.

The stalk 8 can be rigid or semi-rigid.

It is shown as being rectilinear, but in a variant it could be curved.

The wiper orifice 6 has a diameter that is suitable for wiping the stalk 8 and also the applicator element 9 when the applicator is extracted from the receptacle 2.

In a variant, the wiper member could be of any other known type, for example it could be constituted by a block of open-celled foam.

The applicator element 9 can be made integrally with the stalk 8 of the applicator, or it can be fitted thereto.

Figure 2:
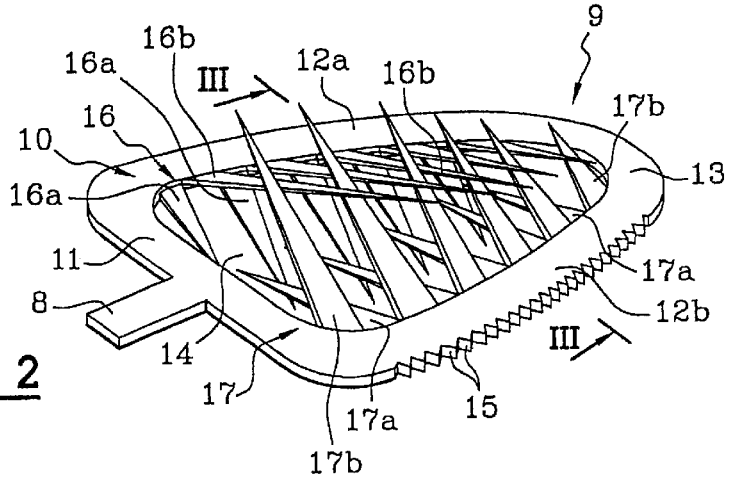
FIG. 2 shows the FIG. 1 applicator in isolation.

FIG. 2 shows the applicator element 9 on a larger scale.

The applicator element 9 comprises a support 10 that is generally in the form of a picture frame, having a rear region 11 extending transversely relative to the longitudinal axis X and connected to the stalk 8, and two side regions 12*a* and 12*b* that meet in a front region 13 of the support 10 remote from the stalk 8.

The support 10 is generally tapering in shape in the forward direction, thus making it easier to pass it through the wiper member 5 when the applicator is put back into the receptacle 2.

The support 10 defines a plane opening 14 which it surrounds completely.

In this case, the thickness of the support 10 is uniform, but it could be of varying thickness, e.g. decreasing towards the front.

The region 12*b* has a series of teeth 15 on its outer edge, which teeth can be used during application.

The applicator element 9 has two series 16 and 17 of protruding elements extending out from the plane of the opening 14.

The first series 16 is made up of a succession of tapering teeth 16*a* and 16*b* that extend alternately beneath and above the plane of the opening 14, and all directed towards the region 12*b*.

The second series 17 comprises a succession of tapering teeth 17*a* and 17*b* extending alternately beneath and above the plane of the opening 14 and all directed towards the region 12*a*.

Figure 3:
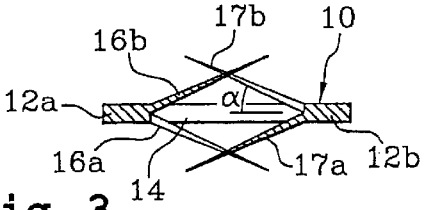
FIGS. 3 to 8 show various configurations of protruding elements on the support.

The teeth 16*a* and 17*a* are interleaved, and the same applies to the teeth 16*b* and 17*b*, as can be seen in FIG. 3 which is a cross-section on section line III—III of FIG. 2.

The teeth 16*a*, 16*b*, 17*a*, and 17*b* are of decreasing length going towards the front.

The angle α formed between the teeth and their orthogonal projection onto the plane of the opening 14 is selected as a function of the desired makeup.

In the example described, it is about 30°, as can be seen in FIG. 3.

In general, the angle α lies strictly between 5° and 90°.

It can also be seen in FIG. 3 that when the protruding elements 16*a*, 16*b*, 17*a*, and 17*b* are projected orthogonally, their projections lie entirely within the opening 14.

Substance can be contained between the teeth in the opening 14, thus enabling the applicator element to continue being used for a satisfactory length of time between refills.

In addition, the configuration of the teeth and the way they are disposed on the support facilitates combing and separating the eyelashes, and also facilitates spreading substance on the surface thereof, as described in greater detail below.

Naturally, the invention is not limited to the configuration shown in FIGS. 2 and 3.

Figure 4:
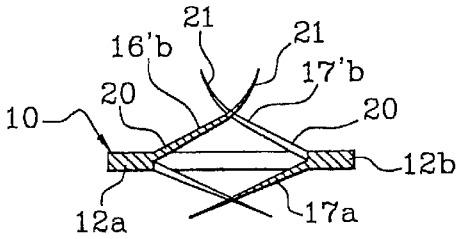

In particular, the shape of the teeth could be varied, as shown in FIG. 4.

In this figure, an applicator element is shown that differs from that described with reference to FIGS. 2 and 3 in that the teeth 16*b* and 17*b* are replaced by teeth 16'*b* and 17'*b* that are not entirely rectilinear, each tooth comprising a rectilinear base 20 with an end 21 that is curved upwardly when the applicator element is seen with its support 10 horizontal and the teeth 16'*b* and 17'*b* situated on the upper side of the support 10.

Figure 5:
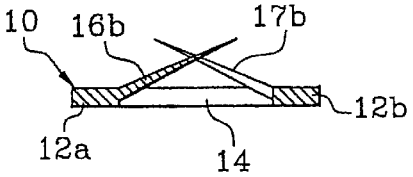

The applicator element could also have teeth on a single side only of the support 10, as shown in FIG. 5.

Figure 6:
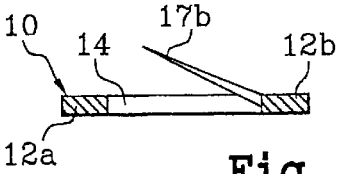

The applicator element could likewise have teeth only on one of the side regions of the support and above only one side thereof, as shown in FIG. 6.

Figure 7:
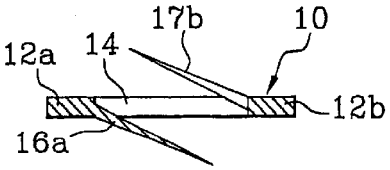

The applicator element could also have protruding elements that connect to one of the side regions and that extend from one side of the support, and protruding elements that connect to the other side region and that extend to the other side of the support, as shown in FIG. 7.

Figure 8:
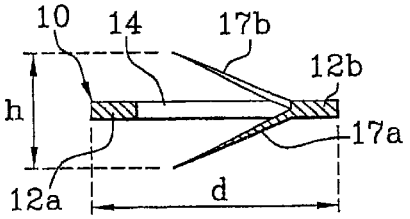

The applicator element could also have protruding elements connected to one of the side regions of the support only, and disposed in alternation on either side of the opening 14, as shown in FIG. 8.

In all of the above-described examples, the transverse size d of the applicator as measured parallel to the opening 14 is greater than the transverse size h measured perpendicularly to the opening 14.

In addition, in the examples described, the dimension d is greater than the diameter of the wiper orifice 6 so that the orifice takes up an elliptical section when the applicator passes therethrough with the applicator being received in the orifice.

By appropriately selecting the diameter for the wiper orifice 6, it is possible to wipe the protruding elements that extend away from the plane of the opening in the support to a greater or lesser extent.

The support can have configurations other than that shown in FIG. 2.

Figure 9:
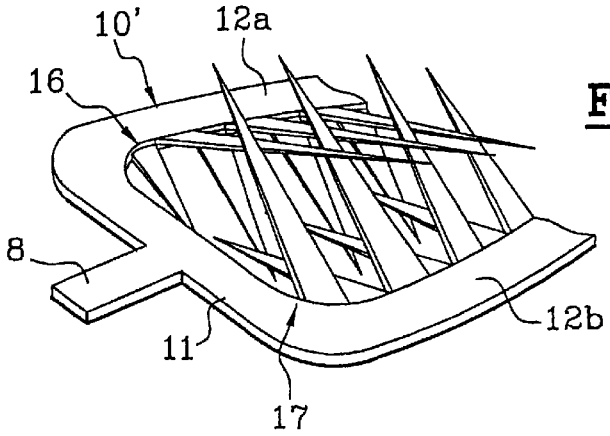
FIGS. 9 to 13 show various configurations of the support.

By way of example, FIG. 9 shows a support 10' which differs from that described with reference to FIG. 2 by the absence of the front region 13 uniting the side regions 12*a* and 12*b*, thereby causing the support to be generally U-shaped.

The applicator embodiment can also have bridges of material passing across the opening defined by the support and interconnecting opposite regions thereof, thereby imparting greater mechanical strength to the support.

Figure 10:
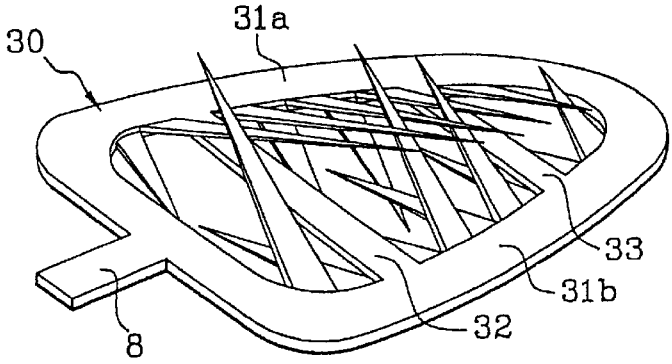

By way of example, FIG. 10 shows a support 30 having side regions 31*a* and 31*b* analogous to the side regions 12*a* and 12*b* of the above-described support 10 with two transverse bridges of material 32 and 33 interconnecting said side regions 31*a* and 31*b*.

Figure 11:
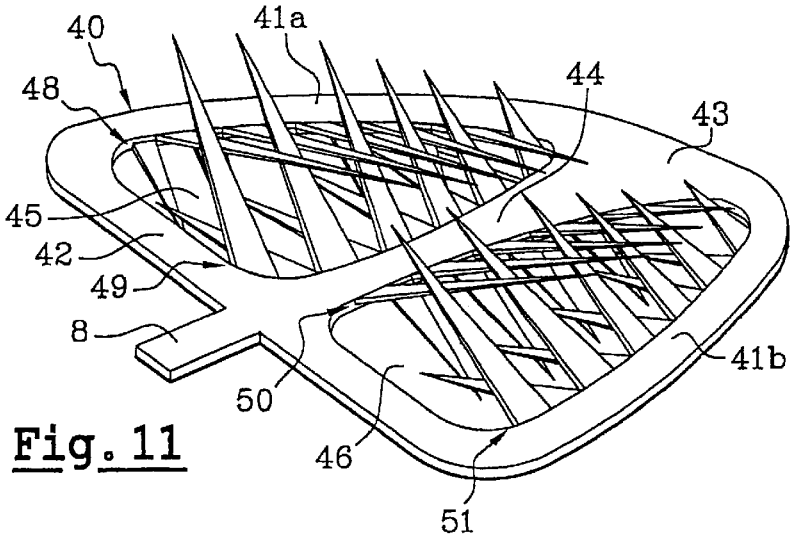

The support 40 shown in FIG. 11 has side regions 41*a* and 41*b*, a rear region 42 connected to the stalk 8, a front region 43, and between the front and rear regions 42 and 43 a bridge of material 44 extending in the longitudinal direction of the support, substantially parallel to the side regions 41*a* and 41*b*.

This bridge of material 44 lies between two openings 45 and 46.

Each opening 45 or 46 is associated with its own two series of protruding elements, and the orthogonal projections of these elements onto the plane of the support extend into said opening.

Thus, the opening 45 is associated with two series of protruding elements 48 and 49 while the opening 46 is associated with two series of protruding elements 50 and 51.

The series 48 and 49 comprise groups of protruding elements which are interleaved respectively above and below the plane of the opening 45.

The series of teeth 50 and 51 likewise comprise protruding elements which are interleaved above and below the plane of the opening 46.

Figure 12:
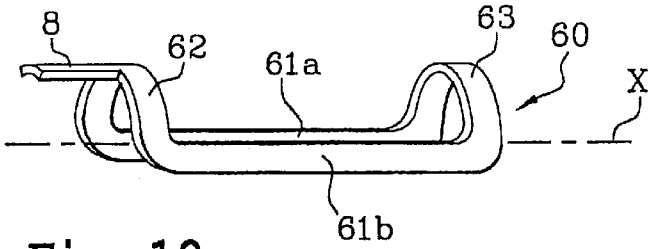

The support need not be plane, and it could have a boat-shaped configuration, as shown in FIG. 12.

This figure shows a support on its own, without any protruding elements in order to clarify the drawing.

It can be seen that the support 60 comprises two side regions 61*a* and 61*b* that are parallel and interconnected at their rear ends, i.e. adjacent to the stalk 8, by an arc 62, and interconnected at their front end by another arc 63.

The arcs 62 and 63 are curved around the longitudinal axis X of the support 60.

Protruding elements (not shown) are connected to the side regions 61*a* and 61*b*.

Figure 13:
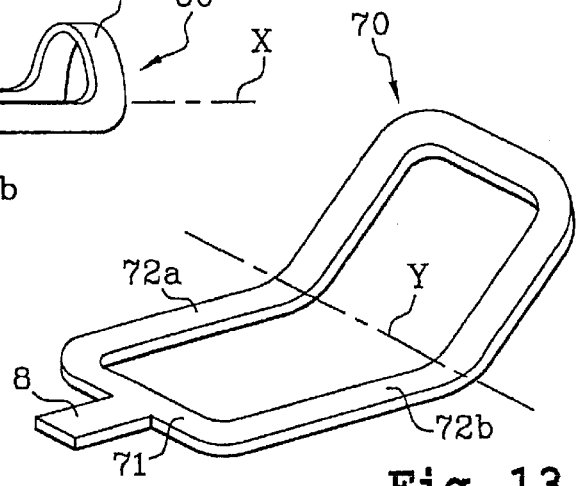

The support can also be curved in shape about a transverse axis, as shown in FIG. 13.

In this figure, there can be seen a support 70 that is in the form of a rectangular frame connected at its rear end via a short side 71 to the stalk 8.

The long sides 72*a* and 72*b* of the frame which constitute side regions of the support are bent substantially halfway along their length in an upwards direction in FIG. 13 about an axis Y which is perpendicular to the longitudinal axis of the support.

The side regions 72*a* and 72*b* carry protruding elements which are not shown in order to clarify the drawing.

The side regions are advantageously curved in such a manner as to match the outline of an eyelid.

The protruding elements can be connected to the support in numerous ways and they can present a variety of configurations.

Figure 14:
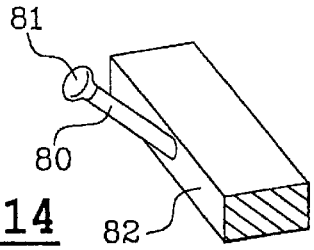
FIGS. 14 to 18 show various configurations of the protruding elements and various ways in which they can be connected to the support.

FIG. 14 shows a portion of a side region of the support, e.g. one of the above-described side regions 12*a* or 12*b*, together with a protruding element 80 that is in the form of a bristle with an enlarged head 81.

This bristle 81 is connected to the side face 82 of the side region of the support that faces into the opening defined by the support, e.g. the above-described opening 14.

The protruding element could also be of some other shape.

Figure 15:
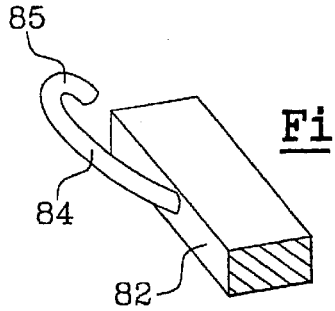

By way of example, FIG. 15 shows a protruding element 84 which is likewise connected to the above-mentioned side face 82 and which is hook-shaped, having a curved free end 85.

Figure 16:
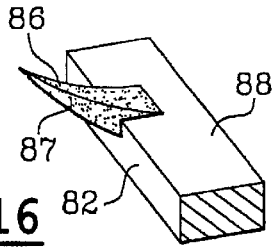

The protruding element can also present a coating of flocking on its surface, as shown in FIG. 16.

This figure shows a protruding element 86 whose surface is covered in a coating of flocking 87.

This protruding element is connected both to the side face 82 and to the top face 88 of the side region of the support.

Figure 17:
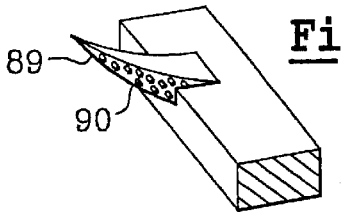

The protruding element can also have portions in relief or roughnesses that are visible to the naked eye, as shown in FIG. 17.

This figure shows a protruding element 89 which is connected to the support in the same way as above-described element 86, and which has points or tips 90 on at least a portion of its surface that serves to improve retention of the substance, and possibly also the ability to take hold of eyelashes.

Figure 18:
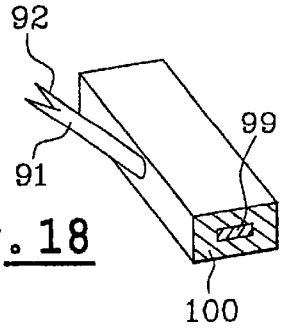

The protruding elements can also include respective forks 92 at their free ends, as is the case for the element 91 shown in FIG. 18, with such a fork improving the combing of the eyelashes at the moment of application.

In addition, this figure shows the possibility of making the support out of a composite structure.

It can be seen that the support comprises reinforcement 99, e.g. of metal, having a coating 100 of plastics material overmolded thereon, with the protruding elements being formed integrally with said coating.

A way in which the applicator element 9 is used is described below, by way of example.

Once it has been filled with substance and withdrawn from the receptacle 2, the support 10 is brought close to the eyelashes and is moved in contact with them in a direction that is transverse relative to its own longitudinal axis.

Figure 19:
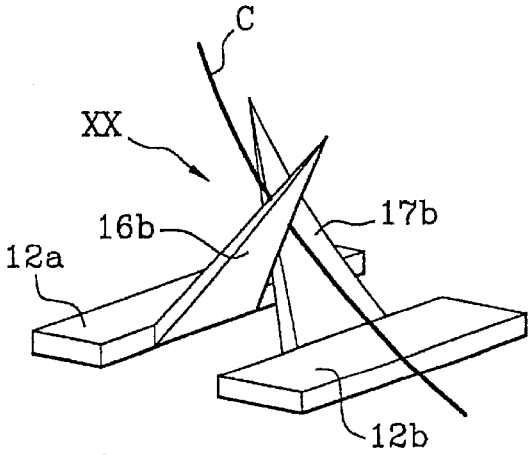
FIG. 19 is a diagrammatic perspective view showing an eyelash engaged between two teeth.
Figure 20:
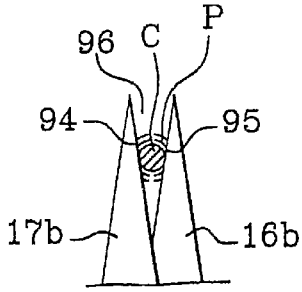
FIG. 20 is a diagrammatic view seen looking along arrow XX in FIG. 19, with the eyelash being shown in section.

Eyelashes C can engage between adjacent teeth, projecting respectively from two opposite side regions of the support, e.g. the teeth 16*b* and 17*b*, as shown in FIGS. 19 and 20.

The eyelash C can become impregnated in substance P present between the teeth and the substance can be smoothed by the adjacent edges 95 and 96 of the two teeth which form a V-groove 96 when the applicator element 9 is seen from the side.

In order to enable the teeth to take hold of the eyelashes, it is preferable to ensure that the spacing between two adjacent teeth projecting from opposite side regions of the support is small enough to ensure that the eyelash cannot reach the support.

The protruding elements can be disposed in other configurations in order to take hold of the eyelashes.

Figure 21:
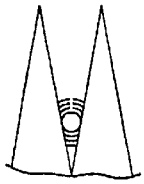
FIG. 21 is a view analogous to FIG. 20, for a different disposition of the teeth.

Thus, as shown in FIG. 21, it is possible to arrange the teeth in such a manner that two teeth projecting from the same side region of the support form a V-groove between them that is suitable for taking hold of an eyelash.

Figure 22:
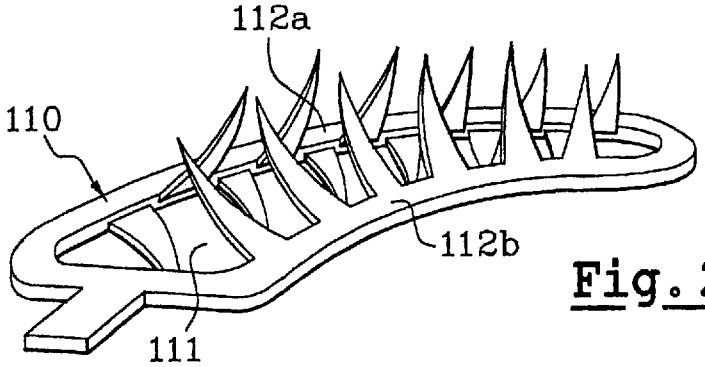
FIG. 22 is a diagrammatic perspective view of a curved applicator.

FIG. 22 shows how the support can be elongate along a curved longitudinal axis.

This figure thus shows a support 110 which defines a kidney-shaped opening 111.

The side regions 112*a* and 112*b* support respective series of protruding elements similar to the two series 16 and 17 described above.

Figure 23:
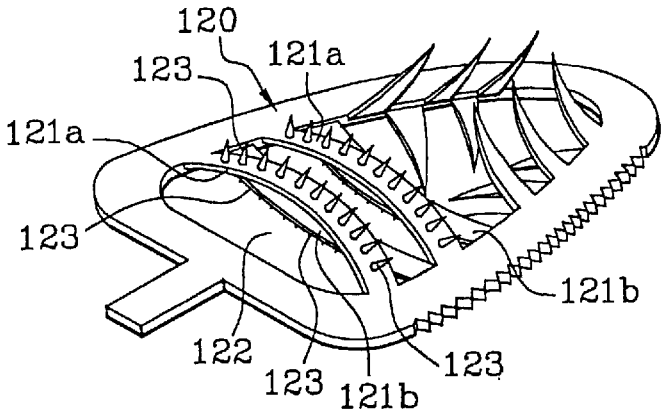
FIG. 23 shows a variant embodiment having a succession of bridges of material disposed alternately on opposite sides of the opening.

FIG. 23 shows an applicator which has a support 120 identical to the support 10 described above.

This applicator has a succession of curved bridges of material 121*a*, 121*b* extending alternately above and below the opening 122 defined by the support 120.

The bridges of material 121*a* are provided on their convex outer faces with points or tips 123.

The same applies to the bridges of material 121*b*.

In the example of FIG. 23, the bridges of material 121*a* and 121*b* extend transversely, but they could also extend longitudinally.

Figure 24:
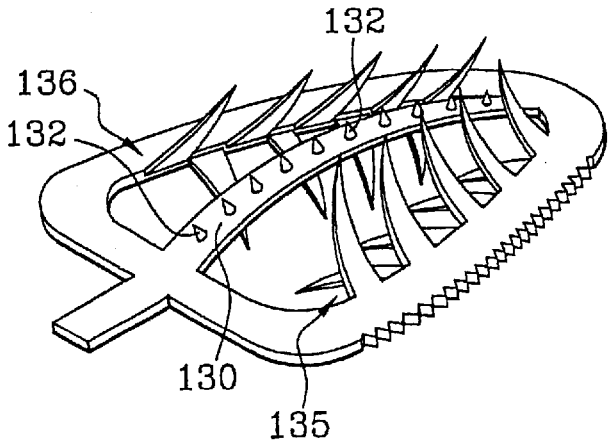
FIG. 24 is a diagrammatic view of a variant applicator.

By way of example, FIG. 24 shows an applicator having a bridge of material 130 extending longitudinally between two series 135 and 136 of protruding elements analogous to the two series 16 and 17 described above.

On its convex outer face, the bridge of material 130 supports a row of points 132.

It will be observed that the points 132 are set back behind the free ends of the protruding elements of the series 135 and 136.

Naturally, the invention is not limited to the embodiments described above.

In particular, an applicator embodiment can be made other than by molding, for example it could be made by cutting out and shaping a sheet of metal.

It is also possible to overmold the protruding elements onto the support by injection molding.

The support can be made with configurations other than those shown, as can the protruding elements.

What is claimed is:

1. An applicator for applying a substance to kerationous fibers, the applicator comprising:

a support comprising a first region, a second region opposite the first region, and an opening defined between the first region and the second region; and a plurality of protruding elements on at least one of the first and second regions and extending toward the other of the first and second regions, wherein the protruding elements are interleaved, and wherein the protruding elements are configured to apply a cosmetic and/or make-up product to eyelashes and/or eyebrows.

2. An applicator according to claim 1, wherein all or some of the protruding elements have respective free ends situated at a distance from said other region.

3. An applicator according to claim 1, wherein the support is closed around said opening.

4. An applicator according to claim 1, wherein the support is generally U-shaped.

5. An applicator according to claim 1, wherein the support is planar.

6. An applicator according to claim 1, wherein the support is nonplanar.

7. An applicator according to claim 6, wherein the support presents a boat-shaped configuration.

8. An applicator according to claim 6, wherein the support is generally elongate in shape along a longitudinal axis and is bent about a transverse axis.

9. An applicator according to claim 6, wherein the support is generally elongate in shape along a longitudinal axis and is bent about said longitudinal axis.

10. An applicator according to claim 1, wherein the support is connected at one end to a link member connected to a handle member.

11. An applicator according to claim 10, wherein the support is generally tapering in shape towards its end remote from the link member.

12. An applicator according to claim 1, wherein the support is generally elongate in shape.

13. An applicator according to claim 12, further comprising at least one bridge of material interconnecting the first and second regions of the support, and wherein said bridge of material extends in the longitudinal direction of the support.

14. An applicator according to claim 12, further comprising at least one bridge of material interconnecting the first and second regions of the support, and wherein said bridge of material extends in the transverse direction of the support.

15. An applicator according to claim 1, further comprising at least one bridge of material interconnecting the first and second regions of the support.

16. An applicator according to claim 5, wherein said bridge of material has at least one protruding element such as a tooth or a point.

17. An applicator according to claim 15, further comprising a succession of curved bridges of material on the same region or alternately on the first and the second regions.

18. An applicator according to claim 1, wherein the support is elongate in shape and wherein the protruding elements comprise protruding elements on at least one of the first and second regions of the support, the at least one first and second region extending substantially parallel to a longitudinal direction of the support.

19. An applicator according to claim 1, wherein the support is made of a material that is more rigid than the material used for making the protruding elements.

20. An applicator according to claim 1, wherein the support is made of an elastomer material.

21. An applicator according to claim 1, wherein the support is of composite structure.

22. An applicator according to claim 21, wherein the support comprises reinforcement and a coating around said reinforcement, and wherein at least some of the protruding elements are made of the same material as the material used for making said coating.

23. An applicator according to claim 1, wherein the protruding elements comprise protruding elements on the first and second regions of the support, with the orthogonal projections of said elements onto the opening extending at least part of the way across the opening.

24. An applicator according to claim 1, wherein the protruding elements are on only one of the first and second regions of the support.

25. An applicator according to claim 1, wherein the protruding elements are on both the first and second regions of the support.

26. An applicator according to claim 25, wherein the protruding elements comprise a first group of protruding elements that are interleaved above the support and a second group of protruding elements that are interleaved beneath the support.

27. An applicator according to claim 1, wherein the protruding elements extend alternately to the first region and to the second region.

28. An applicator according to claim 27, wherein the protruding elements on the same region of the support have bases that do not touch.

29. An applicator according to claim 1, wherein the protruding elements comprise a succession of protruding elements of length that varies as a function of the position of the element on the support.

30. An applicator according to claim 29, wherein the lengths of said protruding elements increase on going away from one of the ends of the support.

31. An applicator according to claim 1, wherein the protruding elements comprise protruding elements having orthogonal projections onto the opening which extend entirely within the opening.

32. An applicator according to claim 1, wherein the protruding elements include protruding elements having orthogonal projections onto the opening which lie partially in the opening and partially on the support.

33. An applicator according to claim 1, wherein at least some of the protruding elements are constituted by teeth of tapering shape.

34. An applicator according to claim 1, wherein for at least some of the protruding elements, the angle formed by the protruding elements with their orthogonal projections ranges from 50° to 900°.

35. An applicator according to claim 1, wherein at least some of the protruding elements are rectilinear in shape.

36. An applicator according to claim 1, wherein at least some of the protruding elements are not rectilinear in shape.

37. An applicator according to claim 1, wherein at least some of the protruding elements present on their surface, flocking, portions in relief visible to the naked eye, or a coating for improving the sliding of eyelashes.

38. An applicator according to claim 1, wherein the protruding elements are made of plastics material.

39. An applicator according to claim 38, wherein said plastics material includes a filler of biocide, of a material for improving sliding, or of magnetic particles.

40. An applicator according to claim 38, wherein the protruding elements are made integrally with the support.

41. An applicator according to claim 1, wherein the length of the protruding elements lies in the range 0.5 mm to 10 mm.

42. An applicator according to claim 1, wherein the protruding elements together with the support define an applicator member whose maximum transverse dimension parallel to the opening is greater than the maximum transverse dimension perpendicular to the opening.

43. An applicator according to claim 1, wherein at least some of the protruding elements are made on at least one of the first and second regions of the support by molding or over-injection onto the support, or by being cut out from a sheet of metal.

44. A packaging and applicator device comprising an applicator as defined in claim 1, and a receptacle for containing a substance to be applied.

45. An applicator according to claim 1, wherein for at least some of the protruding elements, the angle formed by the protruding elements with their orthogonal projections ranges from 10° to 50°.

46. An applicator according to claim 1, wherein for at least some of the protruding elements, the angle formed by the protruding elements with their orthogonal projections ranges from 15° to 30°.

47. An applicator according to claim 1, wherein the length of the protruding elements ranges from 2 mm to 6 mm.

48. An applicator for applying a substance to keratinous fibers, the applicator comprising:

a support comprising a first region, a second region opposite the first region, and an opening defined between the first region and the second region, the opening being closed by the support; and a plurality of protruding elements on at least one of the first and second regions and extending toward the other of the first and second regions, wherein the protruding elements are configured to apply a cosmetic and/or make-up product to eyelashes and/or eyebrows.

49. An applicator according to claim 48, wherein all or some of the protruding elements have respective free ends situated at a distance from said other region.

50. An applicator according to claim 48, wherein the support is planar.

51. An applicator according to claim 48, wherein the support is nonplanar.

52. An applicator according to claim 51, wherein the support presents a boat-shaped configuration.

53. An applicator according to claim 51, wherein the support is generally elongate in shape along a longitudinal axis and is bent about a transverse axis.

54. An applicator according to claim 51, wherein the support is generally elongate in shape along a longitudinal axis and is bent about said longitudinal axis.

55. An applicator according to claim 48, wherein the support is connected at one end to a link member connected to a handle member.

56. An applicator according to claim 55, wherein the support is generally tapering in shape towards its end remote from the link member.

57. An applicator according to claim 48, wherein the support is generally elongate in shape.

58. An applicator according to claim 57, further comprising at least one bridge of material interconnecting the first and second regions of the support, and wherein said bridge of material extends in the longitudinal direction of the support.

59. An applicator according to claim 57, further comprising at least one bridge of material interconnecting the first and second regions of the support, and wherein said bridge of material extends in the transverse direction of the support.

60. An applicator according to claim 48, further comprising at least one bridge of material interconnecting the first and second regions of the support.

61. An applicator according to claim 60, wherein said bridge of material has at least one protruding element such as a tooth or a point.

62. An applicator according to claim 60, further comprising a succession of curved bridges of material extending to the same side of the opening or alternating on opposite sides thereof.

63. An applicator according to claim 48, wherein the support is elongate in shape and wherein the protruding elements comprise protruding elements on at least one of the first and second regions of the support, the at least one first and second region extending substantially parallel to a longitudinal direction of the support.

64. An applicator according to claim 48, wherein the support is made of a material that is more rigid than the material used for making the protruding elements.

65. An applicator according to claim 48, wherein the support is made of an elastomer material.

66. An applicator according to claim 48, wherein the support is of composite structure.

67. An applicator according to claim 66, wherein the support comprises reinforcement and a coating around said reinforcement, and wherein at least some of the protruding elements are made of the same material as the material used for making said coating.

68. An applicator according to claim 48, wherein the protruding elements comprise protruding elements on the first and second regions of the support, the protruding elements having orthogonal projections onto the opening which extend at least part of the way across the opening.

69. An applicator according to claim 48, wherein the protruding elements comprise protruding elements on only one of the first and second regions of the support.

70. An applicator according to claim 48, wherein the protruding elements are on both the first and second regions of the support.

71. An applicator according to claim 70, wherein the protruding elements comprise a first group of protruding elements that are interleaved above the support and a second group of protruding elements that are interleaved beneath the support.

72. An applicator according to claim 48, wherein the protruding elements comprise protruding elements that extend alternately to the first region and to the second region of the support.

73. An applicator according to claim 72, wherein the protruding elements on the same region of the support have bases that do not touch.

74. An applicator according to claim 48, wherein the protruding elements comprise a succession of protruding elements of length that varies as a function of the position of the element on the support.

75. An applicator according to claim 74, wherein the lengths of said protruding elements increase on going away from one of the ends of the support.

76. An applicator according to claim 48, wherein the protruding elements comprise protruding elements having orthogonal projections onto the opening which extend entirely within the opening.

77. An applicator according to claim 48, wherein the protruding elements comprise protruding elements having orthogonal projections onto the op which lie partially in the opening and partially on the support.

78. An applicator according to claim 48, wherein at least some of the protruding elements are constituted by teeth of tapering shape.

79. An applicator according to claim 48, wherein for at least some of the elements, the angle formed by the elements with their orthogonal projections ranges from 5° to 90°.

80. An applicator according to claim 48, wherein for at least some of the elements, the angle formed by the elements with their orthogonal projections ranges from 10° to 50°.

81. An applicator according to claim 48, wherein for at least some of the elements, the angle formed by the elements with their orthogonal projections ranges from 15° to 30°.

82. An applicator according to claim 48, wherein at least some of the protruding elements are rectilinear in shape.

83. An applicator according to claim 48, wherein at least some of the protruding elements are not rectilinear in shape.

84. An applicator according to claim 48, wherein at least some of the protruding elements present on their surface, flocking, portions in relief visible to the naked eye, or a coating for improving the sliding of eyelashes.

85. An applicator according to claim 48, wherein the protruding elements are made of plastics material.

86. An applicator according to claim 85, wherein the protruding elements are made integrally with the support.

87. An applicator according to claim 85, wherein said plastics material includes a filler of biocide, of a material for improving sliding, or of magnetic particles.

88. An applicator according to claim 48, wherein the length of the protruding elements ranges from 0.5 mm to 10 mm.

89. An applicator according to claim 48, wherein the length of the protruding elements ranges from 2 mm to 6 mm.

90. An applicator according to claim 48, wherein the protruding elements together with the support define an applicator member whose maximum transverse dimension parallel to the opening is greater than the maximum transverse dimension perpendicular to the opening.

91. An applicator according to claim 48, wherein at least some of the protruding elements are made on at least one of the first and second regions of the support by molding or over-injection onto the support, or by being cut out from a sheet of metal.

92. A packaging and applicator device comprising an applicator as defined in claim 48, and a receptacle for containing a substance to be applied.

* * * * *

UNITED STATES PATENT AND TRADEMARK OFFICE

CERTIFICATE OF CORRECTION

PATENT NO. : 6,655,390 B2
DATED : December 2, 2003
INVENTOR(S) : Jean-Louis H. Gueret It is certified that error appears in the above-identified patent and that said Letters Patent is hereby corrected as shown below:

Column 8,
Line 38, replace “kerationous” with -- keratinous --;

Column 9,
Line 23, replace “claim 5,” with -- claim 15, --;

Column 10,
Line 22, replace “50º to 900º.” with -- 5º to 90º. --; and

Column 12,
Line 39, replace “the op which” with -- the opening which --.

Signed and Sealed this

Second Day of March, 2004

JON W. DUDAS
*Acting Director of the United States Patent and Trademark Office*